US009515427B2

(12) United States Patent
Wu et al.

(10) Patent No.: US 9,515,427 B2
(45) Date of Patent: Dec. 6, 2016

(54) CABLE CONNECTOR ASSEMBLY HAVING IMPROVED LED STRUCTURE FOR INDICATION

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/141,846

(22) Filed: Apr. 29, 2016

(65) Prior Publication Data

US 2016/0322761 A1 Nov. 3, 2016

(30) Foreign Application Priority Data

Apr. 30, 2015 (CN) ..... 2015 1 0215633

(51) Int. Cl.

| | |
|---|---|
| ***H01R 3/00*** | (2006.01) |
| ***H01R 13/717*** | (2006.01) |
| ***H01R 13/502*** | (2006.01) |
| ***H01R 13/6581*** | (2011.01) |
| ***H01R 24/64*** | (2011.01) |
| *H01R 107/00* | (2006.01) |

(52) U.S. Cl.

CPC ..... *H01R 13/7175* (2013.01); *H01R 13/502* (2013.01); *H01R 13/6581* (2013.01); *H01R 13/7172* (2013.01); *H01R 24/64* (2013.01); *H01R 2107/00* (2013.01)

(58) Field of Classification Search

CPC ..... H01R 13/7175; H01R 13/7172; H01R 13/717; H01R 13/502; H01R 13/6581; H01R 24/64; H01R 2107/00

USPC ..... 439/490, 620.22, 660

See application file for complete search history.

(56) References Cited

U.S. PATENT DOCUMENTS

| | | | | |
|---|---|---|---|---|
| 8,535,088 | B2 | 9/2013 | Gao et al. | |
| 9,028,122 | B2 * | 5/2015 | Tuchrelo | H01R 13/7175 362/253 |
| 2013/0308304 | A1 | 11/2013 | Tuchrelo et al. | |

FOREIGN PATENT DOCUMENTS

| | | |
|---|---|---|
| CN | 102761035 B | 10/2012 |

* cited by examiner

*Primary Examiner* — Khiem Nguyen

(74) *Attorney, Agent, or Firm* — Wei Te Chung; Ming Chieh Chang

(57) ABSTRACT

A cable connector assembly includes a cable and an electrical connector electrically connected with the cable, the electrical connector including a mating member, a printed circuit board (PCB) electrically connected with the mating member, a light emitting element mounted on the PCB, a light pipe to pass the light emitted by the light emitting element therethrough, a metal shell enclosing the PCB, and an outer case covering the metal shell, the light pipe mounted to the PCB, wherein the light pipe defines a first step portion and a second step portion on the bottom side of the first step portion, the first step portion defines a first surface exposing to a light-transmissive region of the outer case, the second step portion defines a second surface, and the metal shell bears against the second surface to press the light pipe against the PCB.

20 Claims, 10 Drawing Sheets

CABLE CONNECTOR ASSEMBLY HAVING IMPROVED LED STRUCTURE FOR INDICATION

BACKGROUND OF THE INVENTION

1. Field of the Invention

The present invention relates generally to a cable connector assembly and more particularly to an improved LED related structure thereof.

2. Description of Related Arts

China Patent Application Publication No. 102761035A, published on Oct. 31, 2012, shows a cable connector assembly including a printed circuit board (PCB), a light emitting diode (LED) mounted on the PCB, a light pipe disposed on a top side of the LED, and an outer case enclosing the PCB. A protruding portion is defined on a top portion of the LED. The light emitted by the LED passes through the outer case from the protruding portion, to indicate the working conditions of the cable connector assembly.

Although the LED is fixed on the PCB, it is not positively retained in position.

U.S. Patent Application Publication No. 2013/0308304, published on Nov. 21, 2013, shows an electrical connector assembly including a housing, a conductor, an electrical connector, a light emitter, and a light guide. The light guide directs light from the light emitter towards a surface of the connector.

U.S. Pat. No. 8,535,088, issued on Sep. 17, 2013, shows a power cable assembly including a cable plug having a housing. The housing includes an LED exit allowing light from an LED inside the housing to escape and a light pipe for guiding light from the LED.

An improved LED related structure in a cable connector assembly is desired.

SUMMARY OF THE INVENTION

An object of the present invention is to provide an improved LED structure in a cable connector for improving the stability of the cable connector assembly.

To achieve the above-mentioned object, a cable connector assembly comprises: a cable including a plurality of wires; and an electrical connector electrically connected with the cable, the electrical connector including a mating member, a printed circuit board (PCB) electrically connected with the mating member, a light emitting element mounted on the PCB, a light pipe to pass the light emitted by the light emitting element therethrough, a metal shell enclosing the PCB, and an outer case covering the metal shell, the light pipe mounted to the PCB; wherein the light pipe defines a first step portion and a second step portion on the bottom side of the first step portion, the first step portion defines a first surface exposing to a light-transmissive region of the outer case, the second step portion defines a second surface, and the metal shell bears against the second surface to press the light pipe against the PCB.

DETAILED DESCRIPTION OF THE PREFERRED EMBODIMENT

Figure 1:
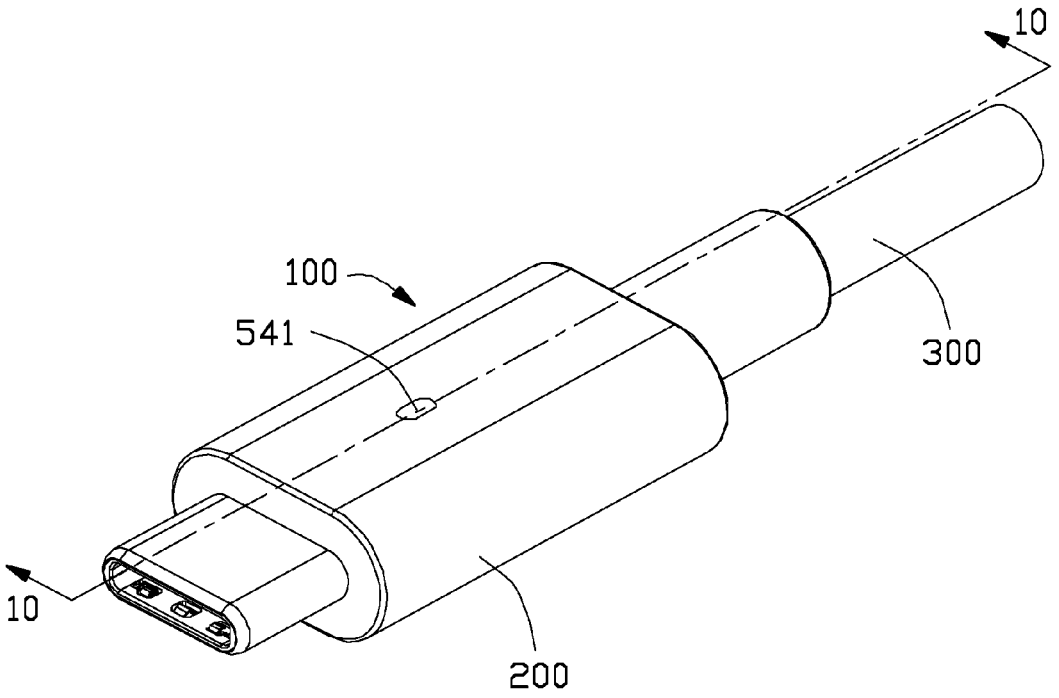
FIG. 1 is a perspective view of a cable connector assembly in accordance with the present invention.
Figure 2:
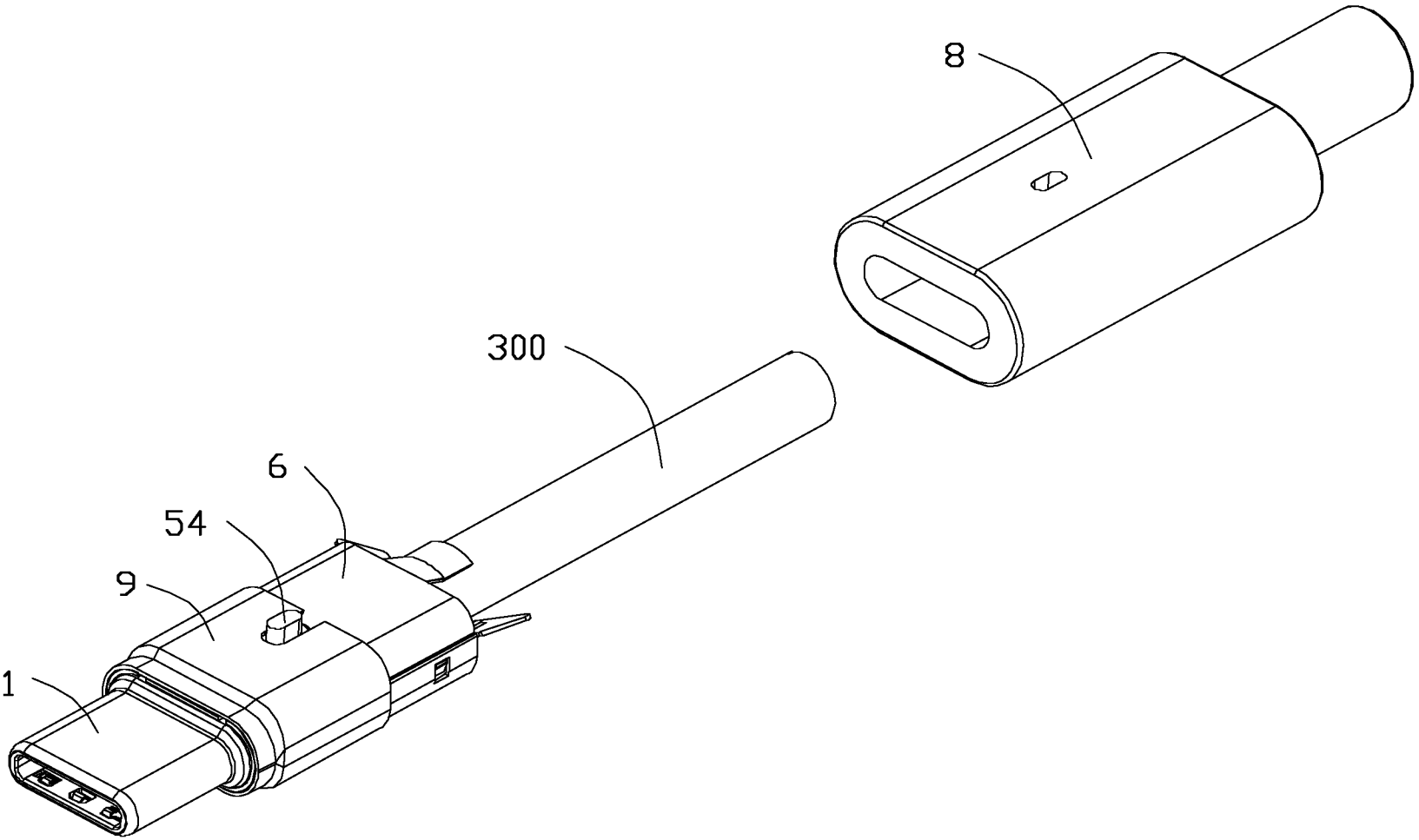
FIG. 2 is a partially exploded view of the cable connector assembly in FIG. 1.
Figure 3:
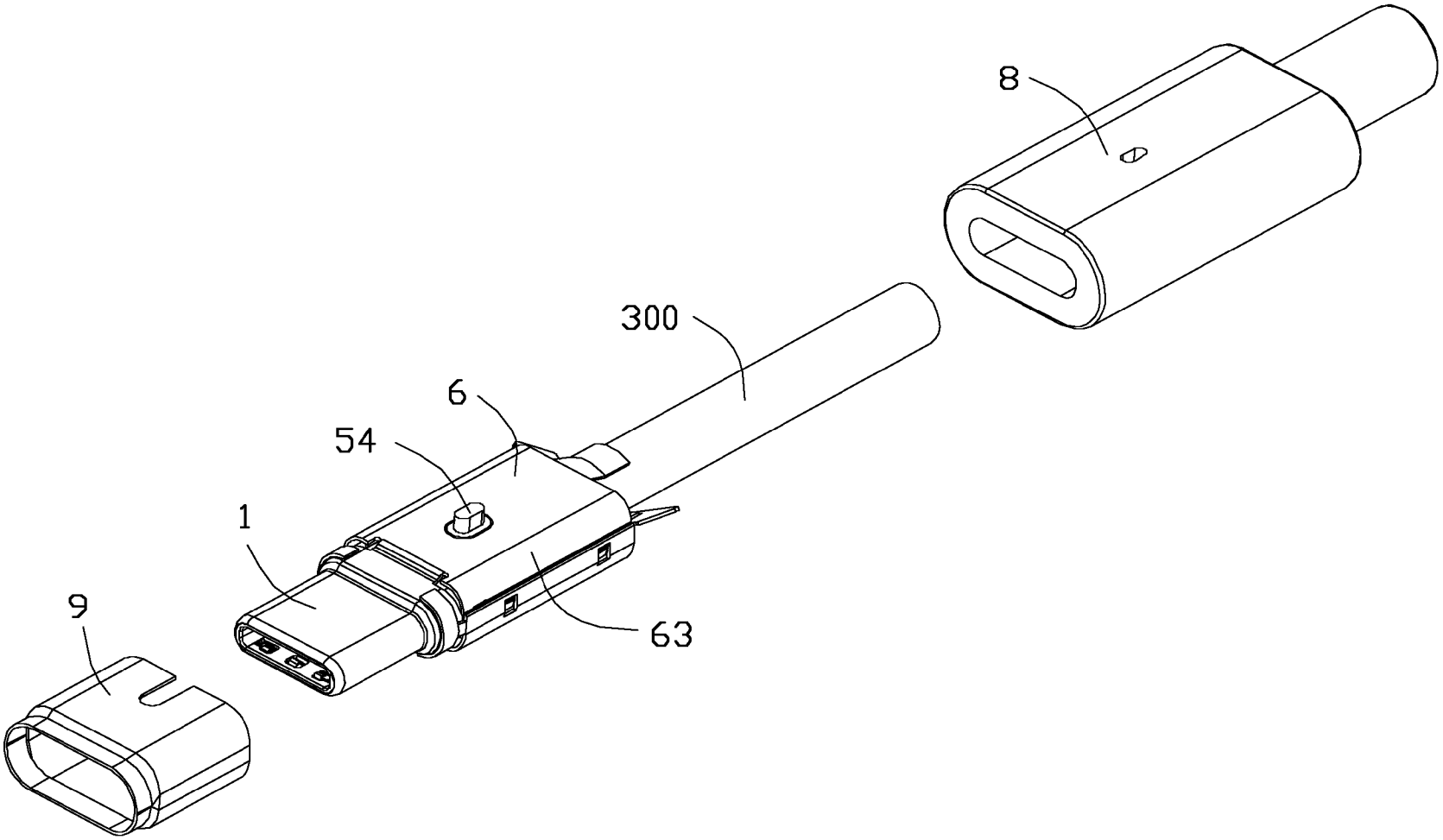
FIG. 3 is a further partially exploded view of the cable connector assembly in FIG. 2.

Referring to FIGS. 1 to 7, a cable connector assembly, e.g., a plug connector assembly 100, in accordance with the present invention for mating with a mating connector (not shown), comprises an electrical connector 200 and a cable 300 electrically connected to the electrical connector 200. The electrical connector 200 includes a mating member 1, a printed circuit board 2 electrically connected with the mating member 1 and disposed along a lateral plane, a plurality of light emitting elements 4 mounted on the printed circuit board 2, a plurality of light pipes 5 to pass therethrough the light emitted by the corresponding light emitting elements 4, a metal case 6 enclosing the printed circuit board 2 and a part of cable 300, an inner mold 7 molded in the metal case 6, an insulative outer case or jacket 8 enclosing the metal shell 6, and a metallic covering member or shell 9 disposed between the metal case 6 and the outer case 8 and formed by drawing. The plug connector assembly 100 can be mated with the mating connector in two orientations.

Figure 8:
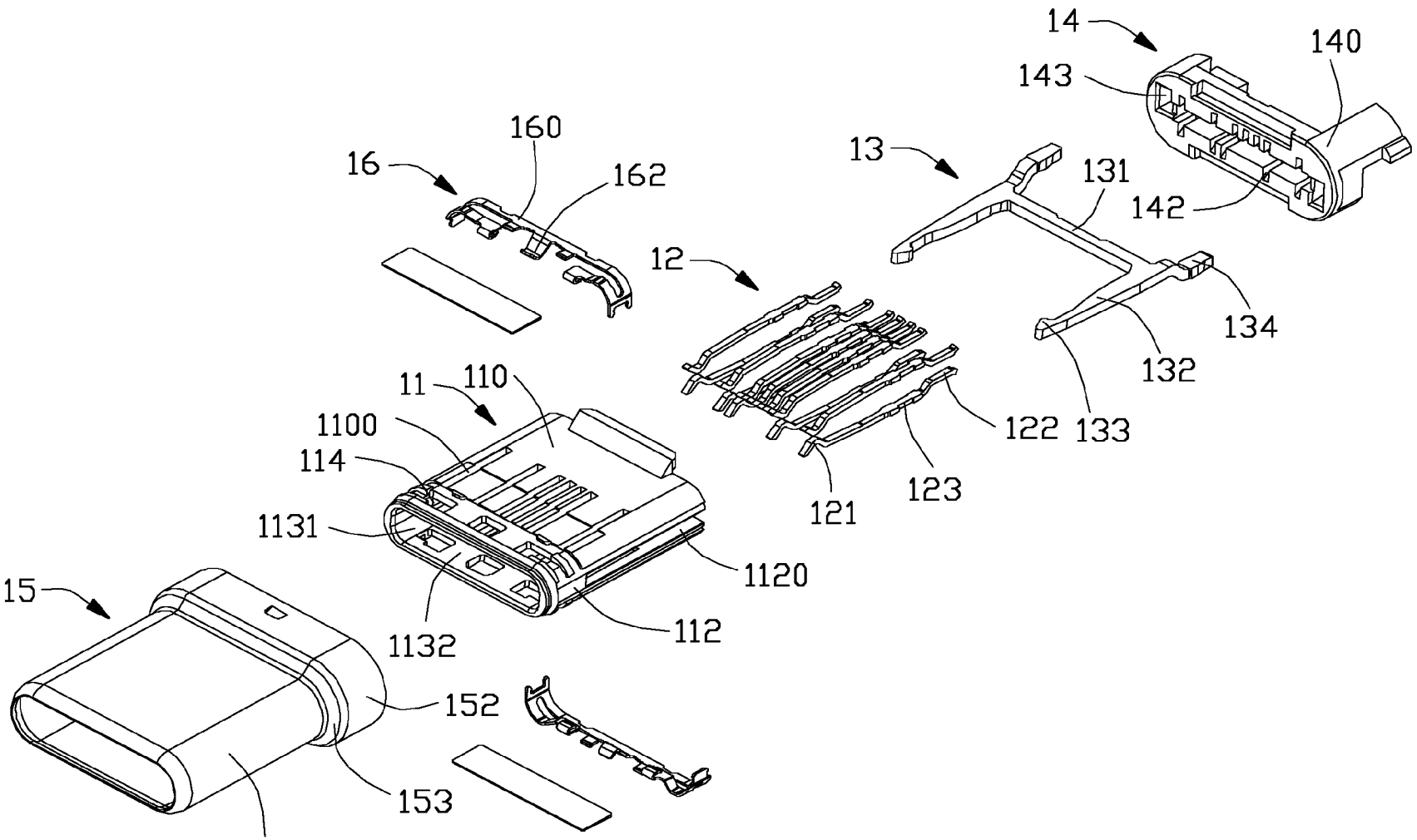
FIG. 8 is an exploded view of the mating member show in FIG. 1.
Figure 9:
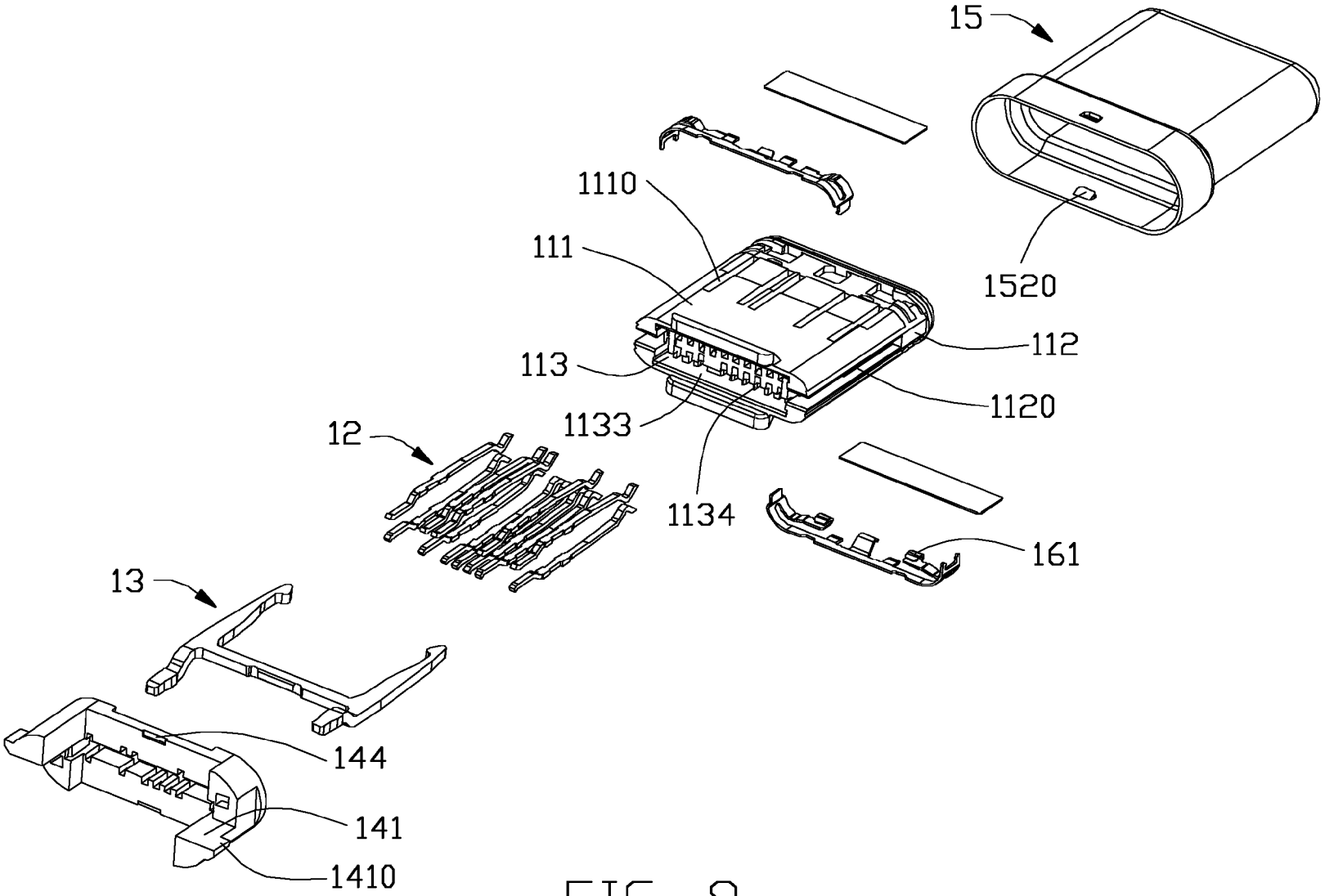
FIG. 9 is an exploded view similar to FIG. 8, but from a different aspect.

Referring to FIGS. 8 and 9, the mating member 1 comprises an insulative housing 11, a plurality of contacts 12 arranged in two rows and spaced apart from each other in a vertical direction, a latch 13 disposed between the two rows of contacts 12 for latching with the mating connector, an insulative member 14 assembled on a rear end of the insulative housing 11, a mating shell 15 covering the insulative housing 11 and the insulative member 14, and a grounding member 16 assembled on the insulative housing 11 and electrically connected to the mating shell 15.

The insulative housing 11 comprises a top wall 110, a bottom wall 111 spaced apart from and parallel with the top wall 110, a pair of side walls 112 parallel to each other and connecting with top wall 110 and the bottom wall 111, a receiving room 113 surround by the top, bottom, and side walls 110, 111, 112, and the receiving room 113 is divided into a front portion 1132 having a front opening 1131 and a rear portion 1134 having a rear opening 1133. The top wall 110 defines a top recess 1100 in communication with the front portion 1132. The bottom wall 111 defines a bottom recess 1110 in communication with the front portion 1132. Each of the side walls 112 defines a side recess 1120 extending forwardly from a rear end of the insulative housing 11 but not through a front end of the insulative housing 11. The side recesses 1120 are in communication with the front portion 1132 and the rear portion 1134 of the receiving room 113. A plurality of slots 114 are defined on a front end of the both top wall and the bottom wall 111.

Each of the contacts 12 comprises a front mating portion 121 extending forwardly into the insulative housing 11, a rear mating/mounting portion 122 extending rearwardly, and an intermediate mounting portion 123 connected between the front mating portion 121 and the rear mating portion 122 and secured to the insulative housing 11. The front mating portion 121 is to be mated with the mating connector and the rear mating portion 122 is to be electrically mated with the printed circuit board 2. The front mating portions 121 of the two rows of contacts 12 are arranged face to face along a vertical direction.

The latch 13 comprises a base portion 131 extending along a transverse direction, a pair of latch beams 132 respectively extending forwardly from two opposite ends of the base portion 131, a latch portion 133 extending from a front end of each latch beam 132 along a face to face direction, and a pair of extension arms 134 respectively extending rearwardly from the two opposite ends of the base portion 131. An extension arm 134 on one side is in a lower plane relative to a plane the base portion 131 located, and another extension arm 134 on another side is in a higher plane relative to the plane the base portion 131 located. The latch 13 is mounted into the insulative housing 11 through the rear opening 1133 of the rear portion 1134 of the receiving room 113 along a rear-to-front direction. The latch beams 132 are received into the side recesses 1120, respectively. At least a portion of the latch portions 133 projects into the front portion 1132 of the receiving room 113. The latch portions 133 are arranged face to face along the left-to-right direction.

The insulative member 14 together with the insulative housing 11 fix the latch 13. The insulative member 14 includes a base portion 140 made of insulative material, a pair of extension portions 141 rearwardly extending from a rear end of the base portion 140. The base portion 140 defines a plurality of through holes 142 therethrough along a front-to-rear direction and arranged in two rows apart from each other along the vertical direction, to pass through the corresponding contacts 12, and a pair of mounting holes 143 defined on the opposites sides of the base portion 140 to pass through the extension arms 134. Each of the extension portions 141 defines an outward protruding sheet 1410 thereon. The dimension of the base portion 140 along the vertical direction is greater than the dimension of the insulative housing 11, thus when the insulative member 14 is mounted on the insulative housing, the insulative member 14 is exposed to the top wall 110 and bottom wall 111 of the insulative housing 11 along the vertical direction. The insulative member 14 is mounted on the insulative housing 11 along a rear-to-front direction, the extension arms 134 extending into the mounting holes 143, the rear mating portions 122 of the contacts 12 passing through the through holes 142. The base portion 140 defines a stuck slot 144.

The mating shell 15 has a closed circumference that has a good seal performance, a good anti-EMI performance, etc. The closed circumference of the mating shell 15 could be manufactured by drawing a metal piece, bending a metal piece, casting metal materials, etc. The mating shell 15 comprises a first front end 151 for being inserted into the mating connector, a first rear end 152 with a larger size than the first front end 151, and a first transition portion 153 for connecting to the first front end 151 and the first rear end 152. The shape of the first rear end 152 is consistent with the insulative member 14. A diametrical dimension of the first front end 151 is smaller than a diametrical dimension of the first rear end 152. The first rear end 152 comprises a pair of latch tabs 1520 projecting outwardly to engage with the stuck slot 144 of the insulative member 14.

The grounding members 16 is a pair, and mounted on the top wall 110 and the bottom wall 111 of the insulative housing 11 respectively. Each of the grounding members 16 includes a main body 160, a pair of resilient sheets 161 extending towards to the insulative housing 11 from the main body 160 and a grounding sheet 162 forwardly extending from a front end of the main body 160 to be received in the first front portion 1132 of the receiving room 113. The resilient sheets 161 and grounding sheet 162 are received in the corresponding slots 114 of the insulative housing 11 respectively. The grounding sheets 162 are to mat with the mating connector. The pair of grounding sheets 162 of the pair of grounding members 16 is arranged face to face along the vertical direction. The direction between the pair of grounding sheets 162 is greater than the direction between the front mating portions 121 of the upper row of contacts 12 and the front mating portions 121 of the lower row of contacts 12 along the vertical direction.

Referring to FIGS. 4 to 7, the printed circuit board 2 is disposed between the mating member 1 and the cable 300, the cable 300 is electrically connected to the contacts 12 via the printed circuit board 2. The printed circuit board 2 includes a front end 21, a rear end 22 disposed on a rear end thereof and a middle portion 23 between the front end 21 and the rear end 22. The printed circuit board 2 includes a top surface 24 and an opposite bottom surface 25. A plurality of first conductive pads 210 are defined on both of the top and bottom surface 24, 25 of the front end 21, to be connected to the corresponding rear mating portions 122 of the contacts 12. A plurality of second conductive pads 220 are defined on the top surface 24 of the rear end 22, to be connected to the cable 300 electrically. The dimension of the front end 21 is smaller than the dimension of the rear end 22 of the printed circuit board 2. The dimension of the second conductive pads 220 is greater than the dimension of the first conductive pads 210. Each of the top surface 24 and the bottom surface 25 of the middle portion 23 defines a metal sheet 26, to be soldered on the corresponding extension arms 134 of the latch 13, for strengthening the fixation of the latch 13. The front end 21 is disposed between the rear mating portions 122 of the upper row of contacts 12 and the rear mating portions 122 of the bottom row of contacts 12, the rear mating portions 122 are connected with the corresponding first conductive pads 210 electrically. The printed circuit board 2 defines a plurality of mounting holes 27 through the top surface 24 and the bottom surface 25 thereof.

The cable 300 has a number of wires 30 and a sheath 31 that contains the wires 30.

In present embodiment, the light emitting elements 4 are LED light. The Light emitted by the light emitting elements 4 is passed through the corresponding light pipes 5. The light emitting elements 4 is a pair, one of the light emitting elements 4 mounted on the top surface 24, and another light emitting element 4 mounted on the bottom surface 25 symmetrically to the light emitting element 4 on the top surface 24.

The light pipes 5 is a pair, including a first light pipe 51 mounted on the top surface 24 and a second light pipe 52 mounted on the bottom surface 25 symmetrically to the first light pipe 51. The first light pipe 51 and the second light pipe 52 are in a same structure. Each of the light pipes 5 includes a base block 53, a first step portion 52 on a top end of the base block 53, a second step portion 54 55 on a top side of the base block 53 and a third step portion 56 formed between the first step portion 54 and the second step portion 55. The base block 53 includes a bottom sidewall 530 contacting with the printed circuit board 2. The bottom sidewall 530 inwardly recessed to form a receiving portion 531 for receiving the light emitting element 4, the receiving portion 531 together with the printed circuit board 2 enclose the light emitting element 4. The bottom sidewall 530 of the first light pipe 51 defines a pair of outwardly projecting first mounting posts 510. The bottom sidewall 530 of the second light pipe 52 defines a pair of outwardly projecting second mounting posts 520. The first mounting posts 510 and the second mounting posts 520 are fixed in the corresponding mounting holes 27 of the printed circuit board 2. The pair of first mounting posts 510 determines a straight line, and the pair of second mounting posts 520 determines a straight line, the two lines are particular to each other, thus the light pipes 5 are mounted on the printed circuit board 2 firmly. The first step portion 54 includes a first surface 541 along a horizontal pane, which is exposed to a light-transmissive region of the outer case 8. The second step portion 55 includes a second surface 551 along a horizontal pane, which is bear against by the metal shell 6, to contact the bottom sidewall 530 of the light pipe 5 to the printed circuit board 2 tightly. The third step portion 56 includes a third surface 561 along a horizontal pane. The thickness of the metal shell 6 is equal to the height of the third step portion 56, that is to say the outer surface of the metal shell 6 maintains the same level with the third surface 561. Treatment the first surface 541, to make it smoother, so that the light emitted from the first surface 541 is brighter.

Figure 4:
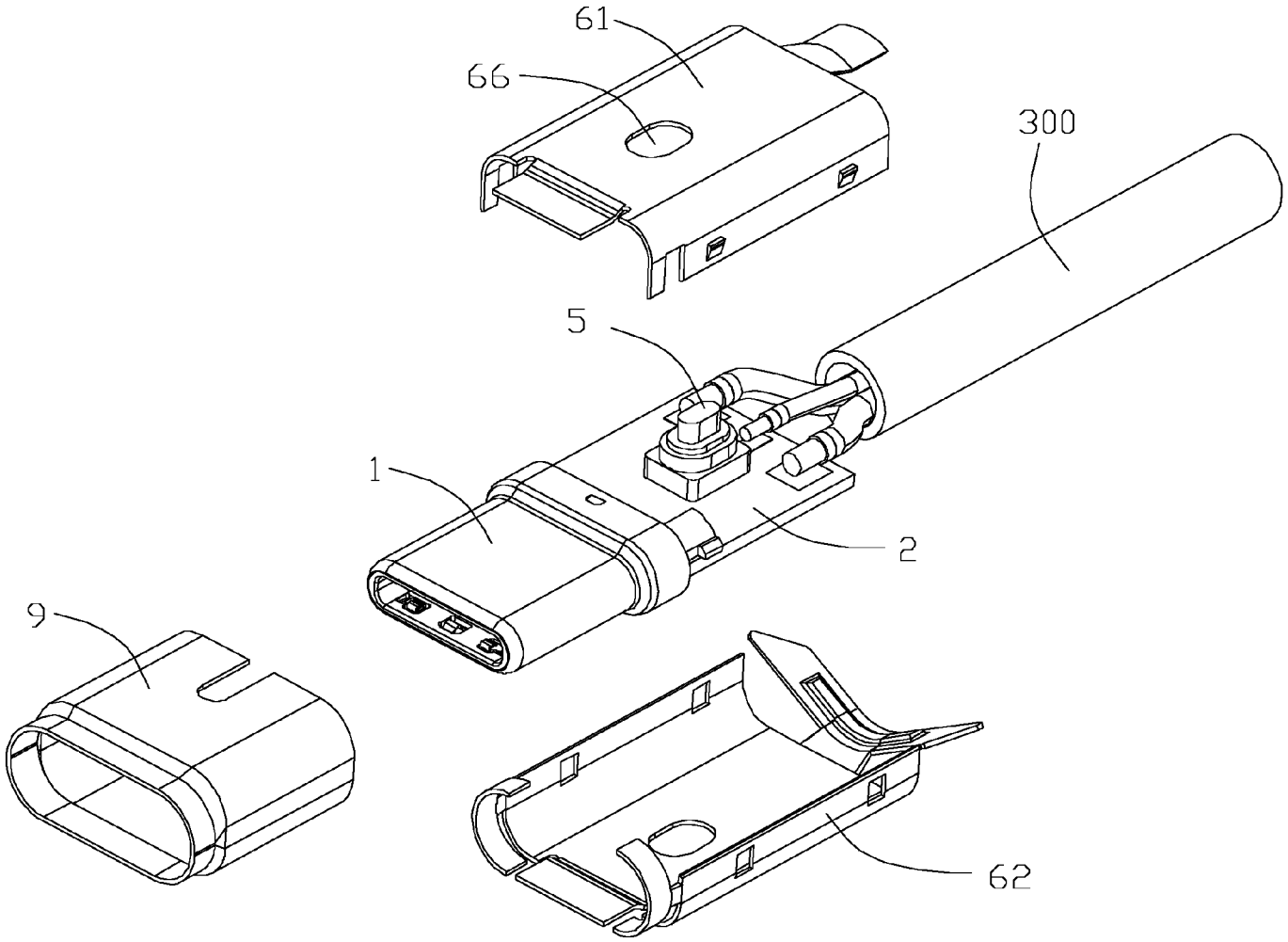
FIG. 4 is a further partially exploded view of the cable connector assembly in FIG. 3.
Figure 5:
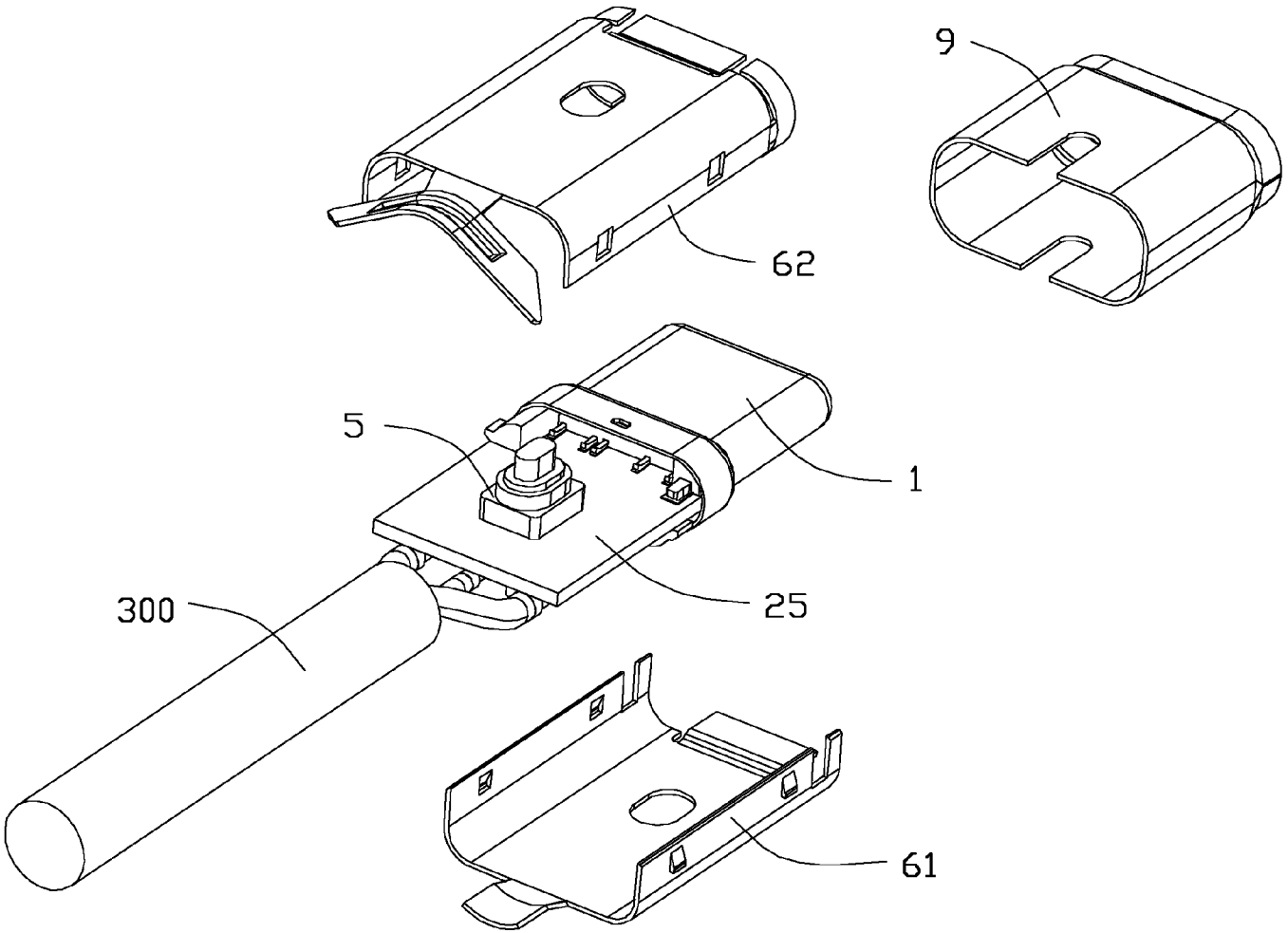
FIG. 5 is a partially exploded view similar to the FIG. 4, but from a different aspect.
Figure 6:
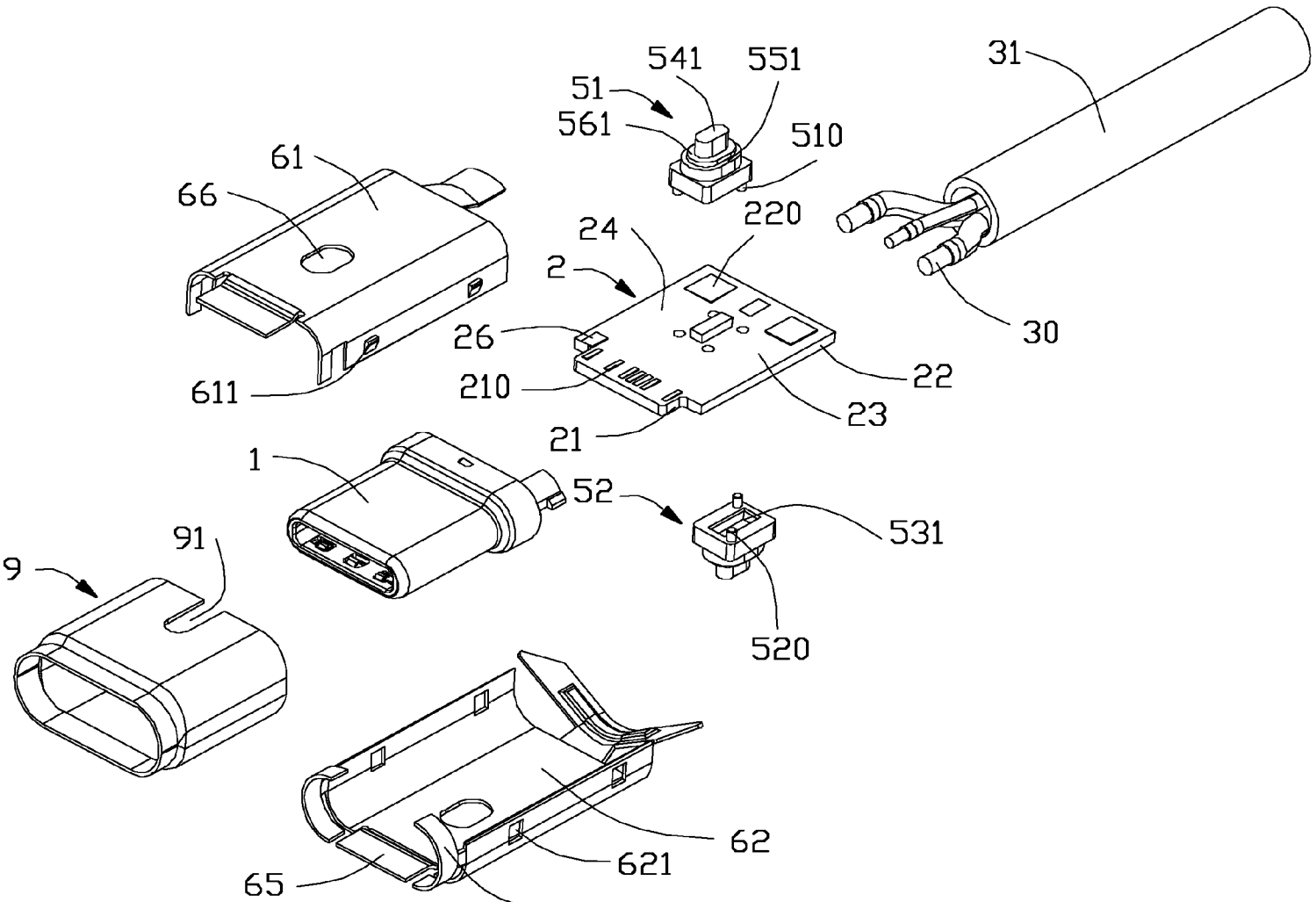
FIG. 6 is an exploded view of the cable connector assembly in FIG. 1, not including the mating member.
Figure 7:
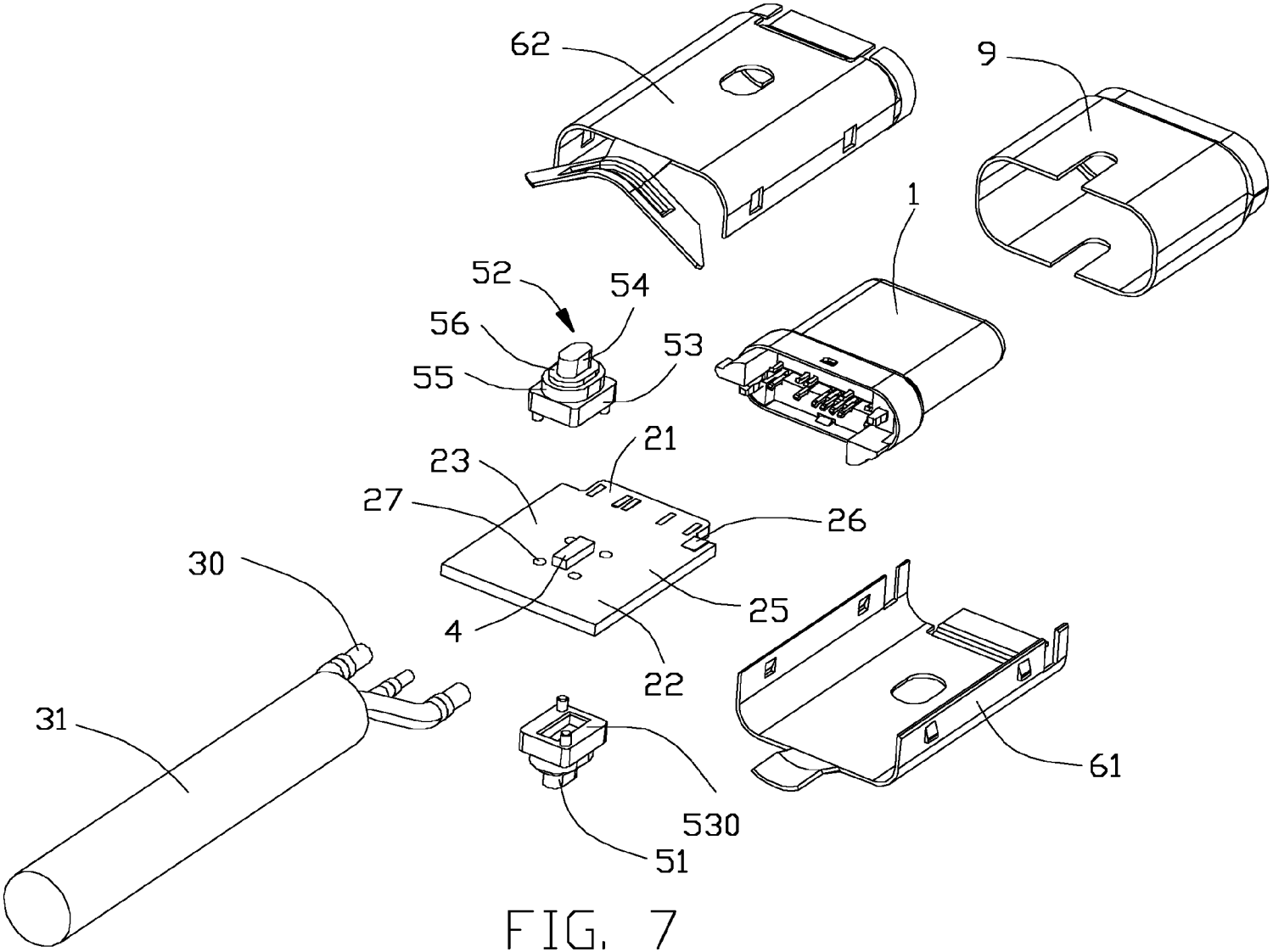
FIG. 7 is an exploded view similar to FIG. 6, but from a different aspect.

Referring particularly to FIGS. 4 and 5, the metal shell 6 includes a first shell 61 and a second shell 62 engaged with the first shell 61. A main body 63 and two holding portions 64 respectively extending from the two opposite sides of the main body 63 to consistent with the surface shape of the mounting portion 152 of the mating shell 15 are formed after the engagement of the first and second shell 61,62. The holding portions 64 are further fixed with the first rear end 152 by soldering. In other embodiment, the holding portions 64 can be fixed on the first rear end 152 using glue or other method. The holding portions 64 are formed on the fist shell 61 or the second shell 62. Both of the first shell 61 and the second shell 62 include a tongue sheet 65 extending from a front end of the main body 63. the tongue sheets 65 are located between the two holding portions 64 and arranged face to face. The pair of tongue sheets 65 is against the top and bottom surface of the first rear end 152 respectively and soldered on the first rear end 152 to be further fixed. A number of holding holes 611 are defined on the both sides of the first shell 61. A number of fixing elastic sheets 621 forming on the both sides of the second shell 62 are fixed in the corresponding holding holes 611 in order to fix the first shell 61 with the second shell 62. Both of the fist shell 61 and the second shell 62 define a through hole 66 to allow the corresponding light emitting elements 4 to pass through, the shape of the through holes 66 are coincident with the periphery of the corresponding third step portions 56 of the light pipes 5.

Figure 10:
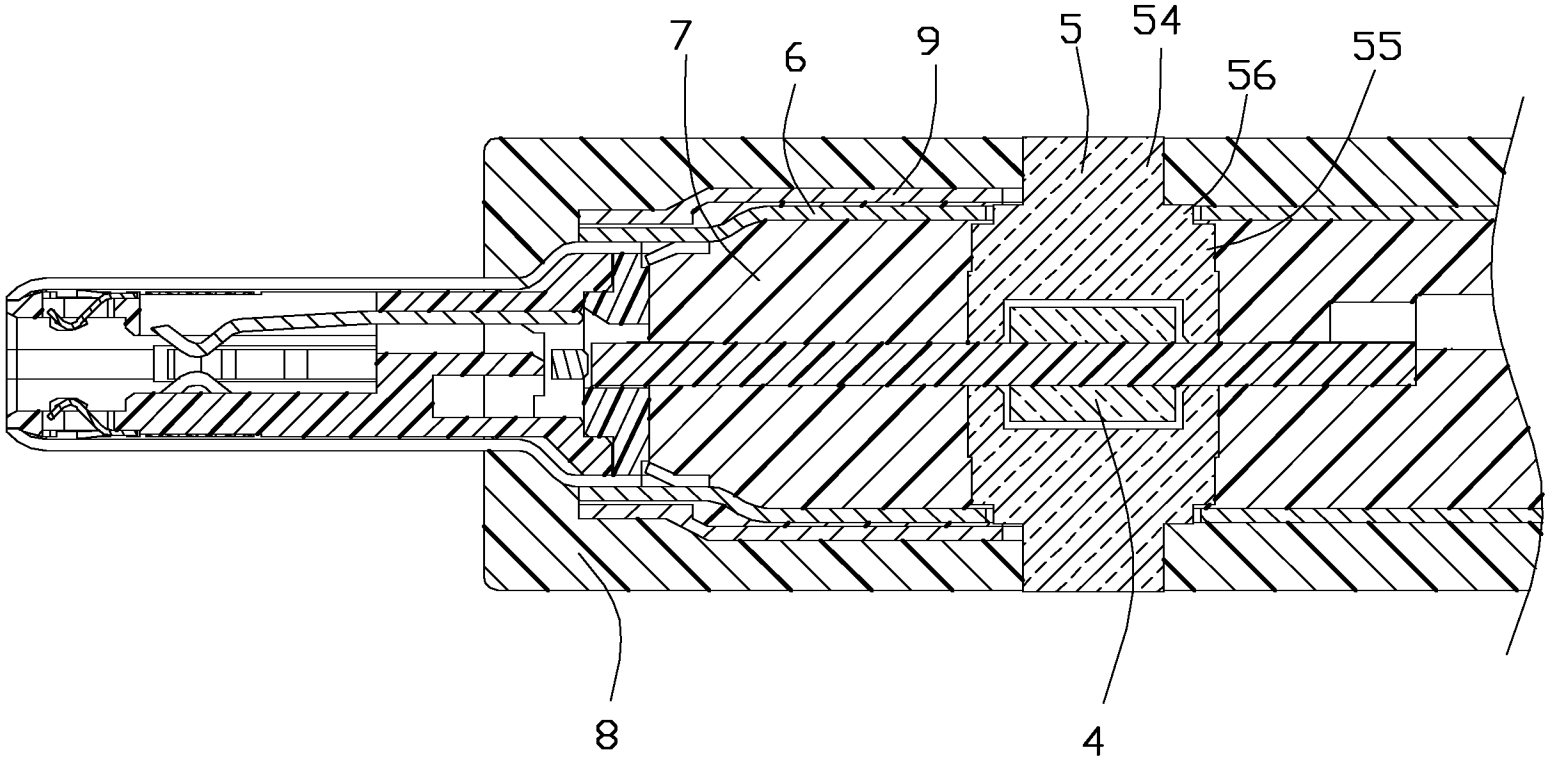
FIG. 10 is a sectional view along the line A-A shown in FIG. 1.

Referring particularly to FIG. 10, the inner mold 7 is molded in the metal shell 6 and encloses the periphery of the light pipes 5, to enhance the fixation of the light pipes 5, simultaneously to prevent the wire 30 falling off from the printed circuit board 2.

The outer case 8 is formed on the metal case 6 and a part of the cable 300, exposing the fist surface 541 of the first step portion 54 therethrough.

The covering member 9 disposed between the metal shell 6 and the outer case 8, to enhance the bending resistance of the cable connector assembly 100. The covering member 9 defines U-shape groove 91 to expose the first step portions 54 of the light pipes.

In assembling the cable connector assembly 100, firstly, the mating member 1 and printed circuit board 2 are provided. The light emitting elements 4 are mounted on the top and bottom surface 24, 25 of the printed circuit board 2. The light pipes 5 are fixed on the printed circuit board 2 by the first mounting posts 510 and second mounting posts 520, to enclose the corresponding light emitting elements 4. The printed circuit board 2 is inserted into the mating member 1. The extension arms 134 of the latch 13 are soldered on the corresponding metal sheets 26 of the printed circuit board 2. The cable 300 is further provided. The wires 30 of the cable 300 are soldered on the corresponding second conductive pads 220 on the rear end 22 of the printed circuit board 2. The metal shell 6 is engaged along a top-to-bottom direction to enclose the printed circuit board 2, bearing against the second surfaces 551 of the light pipes 5, to make the first step portions 54 and the third surfaces 561 of the third step portions 56 expose to the metal shell 6 from the through holes 66. The first shell 61 is fixed with the second shell 62 by the engagement of the fixing elastic sheets 621 and the corresponding holding holes 611. The holding portion 64 is bear against on the first rear end 152 of the mating shell 15. The tongue sheet 65 is soldered on the first rear end 152. In other embodiment, the holding portion 64 can further be fixed by soldering. The first mounting posts 510 and the second mounting posts 520 is to prevent the light pipes 5 moving along the front -to-rear direction. The inner mold 7 is molded from the opposite sides or rear end of the metal shell 6. The covering member 9 is mounted on a front end of the metal shell 6 along a front-to-rear direction, the first step portions 54 of the light pipes 5 exposing to the groove 91 of the covering member 9. The outer case 8 is formed on the metal case 6 and the covering member 9, the first surface 541 of the first step portions 54 of the light pipes 5 exposing to the outer cover 8. Thus, the cable connector assembly 100 is completed. The order of assembly of the cable connector assembly 100 is not unique, art can make adaptation according to installation requirements.

What is claimed is:

1. A cable connector assembly comprising:

a cable including a plurality of wires; and an electrical connector electrically connected with the cable, the electrical connector including a mating member, a printed circuit board (PCB) electrically connected with the mating member, a light emitting element mounted on the PCB, a light pipe to pass the light emitted by the light emitting element therethrough, a metal shell enclosing the PCB, and an outer case covering the metal shell, the light pipe mounted to the PCB; wherein the light pipe defines a first step portion and a second step portion on a bottom side of the first step portion, the first step portion defines a first surface exposing to a light-transmissive region of the outer case, the second step portion defines a second surface, and the metal shell bears against the second surface to press the light pipe against the PCB.

2. The cable connector assembly as claimed in claim 1, wherein a bottom sidewall of the light pipe is recessed inwardly to form a receiving portion for receiving the light emitting element.

3. The cable connector assembly as claimed in claim 2, wherein the light pipe further includes a third step portion disposed between the first step portion and the third step portion.

4. The cable connector assembly as claimed in claim 3, wherein a thickness of the metal shell is equal to a height of the third step portion.

5. The cable connector assembly as claimed in claim 4, wherein:

the PCB includes a top surface and a bottom surface opposite to the top surface; and the light pipe includes a first light pipe mounted on the top surface and a second light pipe mounted on the bottom surface, the first light pipe and the second light pipe having a same structure.

6. The cable connector assembly as claimed in claim 5, wherein:

the first light pipe defines a pair of outwardly projecting first mounting posts;

the second light pipe defines a pair of outwardly projecting second mounting posts; and the PCB defines a plurality of mounting holes receiving the first mounting posts and the second mounting posts.

7. The cable connector assembly as claimed in claim 6, wherein the pair of first mounting posts determine a first straight line perpendicular to a second straight line determined by the pair of second mounting posts.

8. The cable connector assembly as claimed in claim 1, further including a covering member assembled between the metal shell and the outer shell.

9. The cable connector assembly as claimed in claim 8, wherein the covering member includes a groove extending from a rear end thereof along a mating direction to expose the light pipe.

10. The cable connector assembly as claimed in claim 1, further including an inner mold molded in the metal shell.

11. A cable connector assembly comprising:

an insulative housing defining a receiving room forwardly communicating with an exterior along a front-to-back direction;

a metallic first shell surrounding said housing;

a plurality of contacts disposed in the housing, each of said contacts including, along said front-to-back direction, a front mating portion exposed in the receiving room, and a rear mounting portion mechanically and electrically connected to a front region of a printed circuit board which is located behind the housing in said front-to-back direction and defines two opposite first and second surfaces thereon;

a cable including a plurality of wires mechanically and electrically connected to a rear region of the printed circuit board;

at least one LED (laser Emitting Diode) mounted upon one of said first and second surfaces;

a light pipe covering the LED;

a metallic second shell assembled to a rear end of the first shell and enclosing the printed circuit board; and a metallic third shell enclosing a front portion of the second shell; wherein the second shell includes two discrete halves assembled to each other in a vertical direction perpendicular to said front-to-back direction while each of the first shell and the third shell is of one piece made by drawing without seam along the front-to-back direction.

12. The cable connector assembly as claimed in claim 11, wherein each of said second shell and said third shell forms an opening through which the light pipe extends outwardly in the vertical direction.

13. The cable connector assembly as claimed in claim 12, wherein the opening of the third shell defines a U-shaped boundary while the opening of the second shell defines a closed type boundary.

14. The cable connector assembly as claimed in claim 12, further including an insulative outer jacket applied upon exterior surfaces of said second shell and said third shell, wherein an exterior surface of said jacket is flush with an exposed external surface of the light pipe.

15. The cable connector assembly as claimed in claim 14, wherein said light pipe further forms a step structure inward of the exposed external surface of the light pipe in the vertical direction, and said step structure abuts against at least one of the outer jacket and the third shell in the vertical direction.

16. The cable connector assembly as claimed in claim 15, wherein said step structure outwardly abuts against both said outer jacket and said third shell in the vertical direction.

17. The cable connector assembly as claimed in claim 15, wherein said light pipe further includes another step structure inward of said step structure to outwardly abut against the second shell in the vertical direction.

18. A cable connector assembly comprising an insulative housing defining a receiving room forwardly communicating with an exterior along a front-to-back direction;

a metallic first shell surrounding said housing;

a plurality of contacts disposed in the housing, each of said contacts including, along said front-to-back direction, a front mating portion exposed in the receiving room, and a rear mounting portion mechanically and electrically connected to a front region of a printed circuit board which is located behind the housing in said front-to-back direction and defines two opposite first and second surfaces thereon;

a cable including a plurality of wires mechanically and electrically connected to a rear region of the printed circuit board;

at least one LED (laser Emitting Diode) mounted upon one of said first and second surfaces;

a light pipe covering the LED;

a metallic second shell assembled to a rear end of the first shell and enclosing the printed circuit board; and an insulative outer jacket applied upon the second shell; wherein each of said outer jacket and said second shell forms an opening through which a first step structure of the light pipe extends outwardly in the vertical direction; wherein said light pipe further includes a second step structure outwardly abut against the second shell in the vertical direction.

19. The cable connector assembly as claimed in claim 18, further including another LED mounted upon the other of said first and second surface and another light pipe covering said another LED, wherein said light pipe and said another light pipe essentially are same with each other each with a pair of diagonally arranged mounting posts extending through the printed circuit board in an intersecting manner.

20. The cable connector assembly as claimed in claim 18, further including a metallic third shell made via a drawing process to enclose the second shell for reinforcement.

* * * * *